US005983805A

United States Patent [19]

Waluda

[11] Patent Number: 5,983,805

[45] Date of Patent: Nov. 16, 1999

[54] CORNER SHELF ASSEMBLY

[76] Inventor: Casey E. Waluda, 2421 N. Pulaski, Chicago, Ill. 60639

[21] Appl. No.: 09/099,245

[22] Filed: Jun. 17, 1998

Related U.S. Application Data

[63] Continuation-in-part of application No. 29/074,461, Jul. 31, 1997.

[51] Int. Cl.[6] ..... A47B 23/00

[52] U.S. Cl. ..... 108/42; 108/158.12; 211/90.01

[58] Field of Search ..... 108/42, 157.18, 108/158.12; 248/220.1; 211/90.01; 312/238

[56] References Cited

U.S. PATENT DOCUMENTS

| | | | |
|---|---|---|---|
| 326,102 | 9/1885 | Burroughs | 108/158.12 |
| 1,654,409 | 12/1927 | Browne | 211/90.01 X |
| 1,757,398 | 5/1930 | Squires | 108/42 |
| 2,036,184 | 4/1936 | Armstrong | 312/238 X |
| 2,082,236 | 6/1937 | Anderson | 312/238 X |
| 2,363,816 | 11/1944 | Svikhart | 312/238 X |
| 2,368,285 | 1/1945 | Bullard | 312/238 |
| 2,522,442 | 9/1950 | Garris | 108/42 |
| 3,008,585 | 11/1961 | McNeill | 108/42 |
| 4,637,323 | 1/1987 | Nicely . | |
| 4,706,576 | 11/1987 | James . | |
| 4,708,310 | 11/1987 | Smith . | |
| 4,727,815 | 3/1988 | Miller . | |
| 4,852,501 | 8/1989 | Olson et al. . | |
| 5,642,675 | 7/1997 | Webb | 108/42 X |
| 5,724,894 | 3/1998 | Knorovsky | 108/42 |
| 5,755,343 | 5/1998 | Harvey, Sr. | 211/90.01 |

*Primary Examiner*—Peter M. Cuomo
*Assistant Examiner*—Hanh V. Tran
*Attorney, Agent, or Firm*—Arnold White & Durkee

[57] ABSTRACT

A corner shelf assembly adapted to be mounted to vertical walls meeting at a corner. The corner shelf assembly comprises a left support member, a right support member and a base plate. The left support member has a left vertical arm and at least one left base arm intersecting at an angle. The left vertical arm has at least one opening, and the left base arm has a left base arm edge including a left tongue extending from the left base arm edge. The right support member is orientated perpendicular to the left support member. The right support member has a right vertical arm and at least one right base arm intersecting at an angle. The right vertical arm has at least one tab capable of entering the opening in the left support member for releasably interlocking the right support member to the left support member. The right base arm has a right base arm edge including a right tongue extending from the right base arm edge. The base plate is releasably connected to the left base arm and to the right base arm. The base plate has a left opening capable of accepting the left tongue and a right opening capable of accepting the right tongue.

22 Claims, 6 Drawing Sheets

CORNER SHELF ASSEMBLY

RELATED APPLICATION

This application is a continuation-in-part of application Ser. No. 29/074,461 filed Jul. 31, 1997.

FIELD OF THE INVENTION

The present invention relates generally to wall shelving devices. More particularly, the present invention relates to a corner shelf assembled from releasably interlocking components.

BACKGROUND OF THE INVENTION

A wall shelving device is generally a rigid structure comprising support members and a shelf member connected together for mounting to a vertical wall or other vertical surface. The shelf member of the shelving device provides a horizontal surface used to hold, store and/or display objects. Often the shelving device has an ornamental appearance to provide decoration.

Typically, wall shelving devices are manufactured by permanently connecting the supporting members to the shelf member. Thus, the shelving device sold to consumers is ready to mount to a wall. One problem with producing wall shelving devices with their components permanently connected is their size. The permanently assembled shelving devices occupy a large amount of retail space when being displayed for sale. Additionally, the permanently connected shelving devices require a large amount of shipping space when being delivered. Furthermore, the permanently connected shelving devices require special protective packaging when being shipped to protect them from damage. Moreover, the permanently connected shelving devices require additional labor costs to attach the components of the shelving device together.

The permanently connected shelving devices also cause problems for consumers. One problem for consumers is the permanently connected shelving devices' size. Some consumers may wish to hang a shelve only during certain seasons, such as Christmas. Thus, the shelving device requires considerable storage space for the rest of the year. Additionally, the permanently connected shelving devices require a large amount of shipping space when the consumers take them home from a store. Furthermore, the bulky, permanently connected devices are subject to damage by careless consumers.

Some shelving devices are sold as assemblies requiring the consumer to connect the support members and shelf member after purchase. Typically, these shelving device assemblies include screw type connectors or adhesives. The consumer after purchasing the shelving device assembly must either screw or glue the support members and shelf member together. One problem with this connecting process is that it is often frustrating and time consuming for the typical purchaser.

Conventional wall shelving devices may be categorized into two different applications: 1) for mounting on a flat wall surface or 2) mounting in a corner wall surface. In the flat wall mounting shelving device, the support members typically orientated such that they provide a surface that aligns with the flat surface of the wall.

In the corner mounting shelving device, the support members are typically orientated perpendicular to each other such that the support members align with two wall surfaces that intersect at approximately 90°. One problem with the typical flat wall mounting shelving device is that it cannot be mounted in the corner wall surface; likewise, the corner mounting shelving device cannot be mounted on the flat wall surface.

Thus, the need has arisen for a new shelving device which will be small size, easy to ship, easy to protect from damage, easy to assemble and disassemble, and capable of being mounted on a flat wall surface or a corner wall surface.

SUMMARY OF THE INVENTION

In accordance with one aspect of the present invention, there is provided a corner shelf assembly adapted to be mounted to vertical walls meeting at a corner.

The corner shelf assembly comprising a left support member, a right support member and at least one base plate releasably connected together. The left support member has a left vertical arm and at least one left base arm intersecting at an angle. The left vertical arm has at least one opening, and the left base arm has a left base arm edge. The left base arm includes a left tongue extending from the left base arm edge. The right support member is orientated perpendicular to the left support member. The right support member has a right vertical arm and at least one right base arm intersecting at an angle. The right vertical arm has at least one tab capable of entering the opening in the left support member for releasably interlocking the right support member to the left support member. The right base arm has a right base arm edge, and the right base arm includes a right tongue extending from the right base arm edge. The base plate is releasably secured to the left base arm and to the right base arm. The base plate has a left opening capable of accepting the left tongue and a right opening capable of accepting the right tongue for releasably interlocking the base plate to the left support member and the right support member.

In accordance with another aspect of the present invention, there is provided a corner shelf assembly adapted to be mounted to a flat vertical wall. The corner shelf assembly comprises a left support member, a right support member and at least one base plate releasably connected together as described above. To mount the corner shelf assembly on a flat vertical wall, the present invention incorporates a flat wall mounting member. The flat wall mounting member has a wall edge adapted to abut the surface of the flat wall, and the flat wall mounting member has a corner shelf edge adapted to hold both the left support member and the right support member at a display angle to the wall. The corner shelf edge has a left surface intersecting a right surface at approximately ninety degrees to accommodate the perpendicularly orientated left support member and right support member.

BRIEF DESCRIPTION OF THE DRAWINGS

The foregoing and other advantages of the invention will become apparent upon reading the following detailed description and upon reference to the drawings which.

Figure 1:
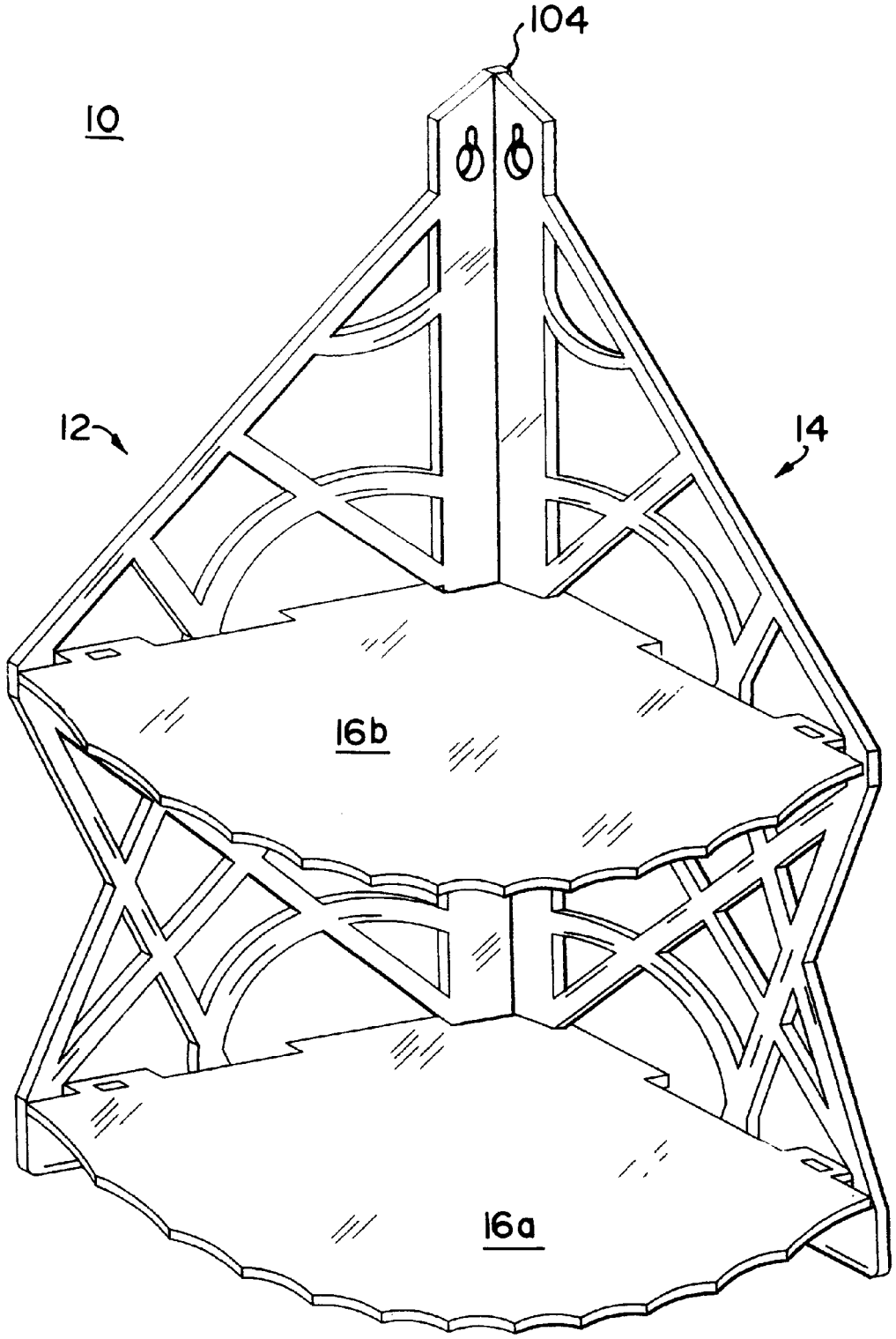
FIG. 1 is an isometric view of an assembled corner shelf of the present invention.

While the invention is susceptive to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DESCRIPTION OF ILLUSTRATIVE EMBODIMENTS

Surprisingly, it has been discovered that a corner shelf assembly of the present invention requires a small retail display space and small shipping space, may be easily assembled and disassembled by consumers, and may be mounted either on a flat wall surface or a corner wall surface.

FIG. 1 illustrates the corner shelf 10 of the present invention. The corner shelf depicted in FIG. 1 may be mounted on a flat wall surface or in a corner wall surface. The corner shelf 10 comprises a left support member 12 releasably connected to a right support member 14 and at least one base plate 16*a* and 16*b* releasably connected to the left and right support members 12 and 14. In the embodiment illustrated in FIG. 1, the corner shelf assembly 10 has two base plates 16*a* and 16*b*. In other embodiments, the corner shelf assembly may have only one base plate or any number of base plates. The left and right support members 12 and 14 are vertically orientated to be parallel to the vertical wall surface and the base plates 16*a* and 16*b* are horizontal orientated to provide a surface for displaying objects. To provide the releasably connecting feature of the corner shelf assembly 10, the left support member 12, the right support member 14 and the base plates 16*a* and 16*b* have releasably connecting elements which cooperate to securely connect the corner shelf assembly 10 together while allowing the corner shelf to be readily disassembled.

Figure 2:
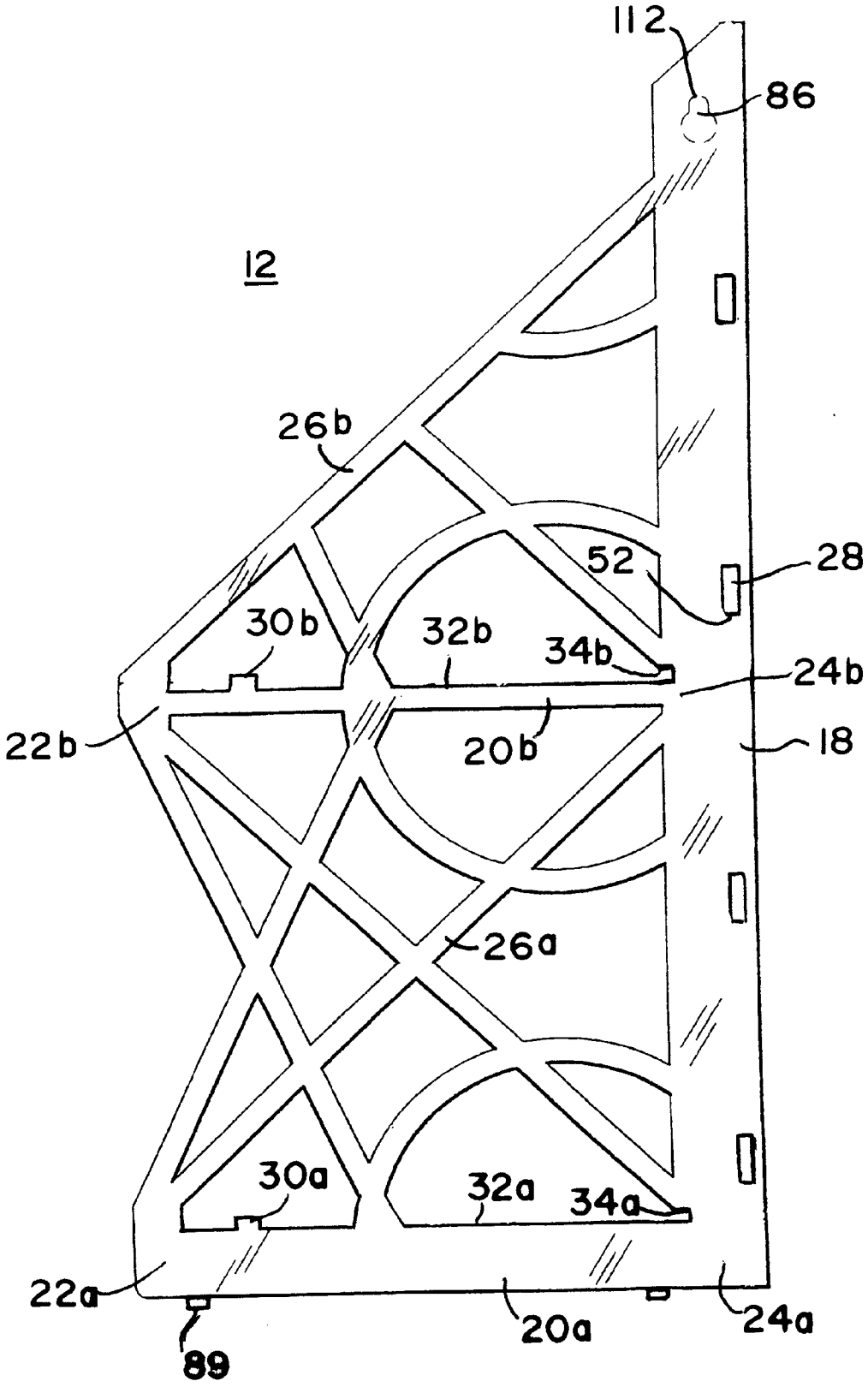
FIG. 2 is a side view of a left support member of the corner shelf illustrated in FIG. 1.

The left support member 12 of one embodiment is illustrated in FIG. 2. The left support member 12 comprises a left vertical arm 18 and at least one left base arm 20*a* and 20*b* to accommodate the base plates 16*a* and 16*b*. The base arms 20*a* and 20*b* have a display end 22*a* and 22*b* and a intersecting end 24*a* and 24*b*. In one embodiment, the left vertical arm 18 intersects the intersecting end 24*a* and 24*b* of the base arms 20*a* and 20*b* at an angle of approximately ninety degrees; however, in other embodiments the angle of intersection may be less or greater than ninety degrees. The left base arms 20*a* and 20*b* support the base plates 16*a* and 16*b* respectively. The left support member 12 also has at least one left cross arm 26*a* and 26*b* attached at one end to the left vertical arm 18 at a point above the intersection of the left vertical arm 18 and the corresponding left base arm 20*a* and 20*b*. The other end of the left cross arm 26*a* and 26*b* is attached to display end 22*a* and 22*b* of the left base arms 20*a* and 20*b*. The left cross arms 26*a* and 26*b* help support the base arms 20*a* and 20*b,* the base plate 16*a* and 16*b* and any objects displayed on the shelf.

To provide the releasably connecting feature of the corner shelf assembly 10, the left vertical arm 18 and the left base arms 20*a* and 20*b* have releasably connecting elements. The left support member 12 includes at least one opening 28 in the left vertical arm 18 to releasably connect the left support member 12 to the right support member 14. The left support member 12 depicted in FIG. 2 has four openings 28 spaced along the vertical arm 18. In other embodiments, other numbers of openings 28 may be used to provide the releasably connected feature.

To provide the releasably connecting feature of the corner shelf assembly 10, the left base arms 20*a* and 20*b* have a left tongue 30*a* and 30*b* adjacent the display end 22*a* and 22*b*. The left tongues 30*a* and 30*b* extend upward from a left base arm edge of 32*a* and 32*b* the base arms 20*a* and 20*b* to releasable connect the left support member 12 to the base plates 16*a* and 16*b*. In one embodiment, the left support member also includes a left shoulder 34*a* and 34*b* at the intersecting ends 24*a* and 24*b*. The left shoulders 34*a* and 34*b* are gap at the intersection of the left vertical arm 18 and the left base arms 20*a* and 20*b* to releasable capture the base plates 16*a* and 16*b*.

Figure 3:
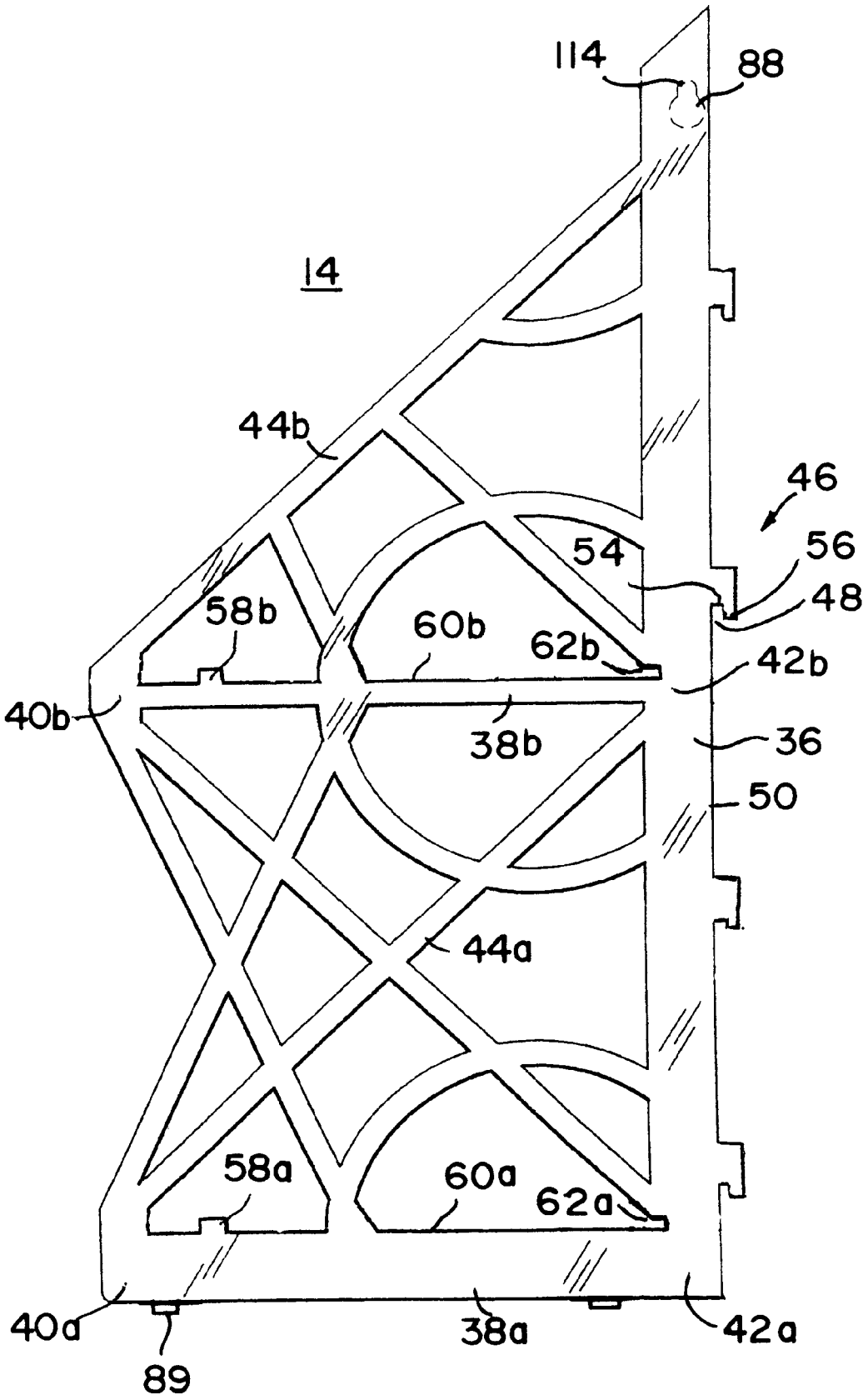
FIG. 3 is a side view of a right support member of the corner shelf illustrated in FIG. 1.

In the embodiment depicted in FIG. 1, the corner shelf assembly includes the right support member 14 orientated at an angle of approximately ninety degrees to the left support member 12. In other embodiments, the right support member 14 may be orientated at angles greater than or less than ninety degrees to the left support member 12. The right support member 14 of one embodiment is illustrated in FIG. 3. The right support member 14 comprises a right vertical arm 36 and at least one right base arm 38*a* and 38*b*. The right base arms 38*a* and 38*b* have a display end 40*a* and 40*b* and a intersecting end 42*a* and 42*b*. In one embodiment, the right vertical arm 36 intersects the intersecting end 42*a* and 42*b* of the right base arms 38*a* and 38*b* at an angle of approximately ninety degrees; however, in other embodiments the angle of intersection may be less or greater than ninety degrees. The right base arms 38*a* and 38*b* support the base plates 16*a* and 16*b* respectively. The right support member 14 also has at least one right cross arm 44*a* and 44*b* attached at one end to the right vertical arm 36 at a point above the intersection of the right vertical arm 36 and the respective right base arm 38*a* and 38*b*. The other end of the right cross arm 44*a* and 44*b* is attached to the display end 40*a* and 40*b* of the right base arms 38*a* and 38*b*.

The right cross arms 44*a* and 44*b* help support the base arms 38*a* and 38*b,* the base plate 16*a* and 16*b* and any objects displayed on the shelf.

To provide the releasably connecting feature of the corner shelf assembly 10, the right vertical arm 36 and the right base arms 38*a* and 38*b* have releasably connecting elements. The right support member 14 includes at least one tab 46 extending outwardly from the right vertical arm 36 to releasably connect the right support member 14 to the left support member 12. The right support member 14 depicted in FIG. 3 has four tabs 46 spaced along the vertical arm 18. In other embodiments, other numbers of tabs 46 may be used to correspond to the number of openings 28.

The tab 46 has a size that conforms to the size of the opening 28 to allow the tab to enter the opening 28. Each of the tabs 46 have a notch 48 that provides an interlocking feature. The notch 48 has a width approximately equal to the thickness of the left vertical arm 18 to coordinate the releasable interlocking of the left and right support members 12 and 14. The tab 46 enters the opening 28 until an edge 50 of the right vertical arm 36 abuts the left vertical arm 18. The right support member 14 then slides downward relative to the left support member 12 until a bottom portion 52 of the opening 18 abuts a top portion 54 of the notch 48. Once the bottom portion 52 of the opening 28 abuts the top portion 54 of the notch 48, a lip 56 of the tab 46 prevents the two members 12 and 14 from moving horizontally with respect to each other. The left and right support member 12 and 14 may be separated by sliding the right support member 14 upward with respect to the left support member 12 until the lip 56 of the tab 46 clears the bottom portion 52 of the opening 28, then the tab 46 may exit the opening 28. The opening 28 of the left support member 12 and the tab 46 of the right support member 12 cooperate to releasably connect the left support member 12 and the right support member 14.

To provide the releasably connecting feature of the corner shelf 10, the right base arms 38*a* and 38*b* have a right tongue 58*a* and 58*b* adjacent the display end 40*a* and 40*b*. The right tongues 58*a* and 58*b* extend upward from a right base arm edge 60*a* and 60*b* of the base arms 38*a* and 38*b* to releasable connect the right support member 14 to the base plates 16*a* and 16*b*. In one embodiment, the right support member 14 also includes a right shoulder 62*a* and 62*b* at the intersecting ends 42*a* and 42*b*. The right shoulders 62*a* and 62*b* are gaps at the intersection of the right vertical arm 36 and the right base arms 38*a* and 38*b* to releasable capture the base plates 16*a* and 16*b*.

Figure 4:
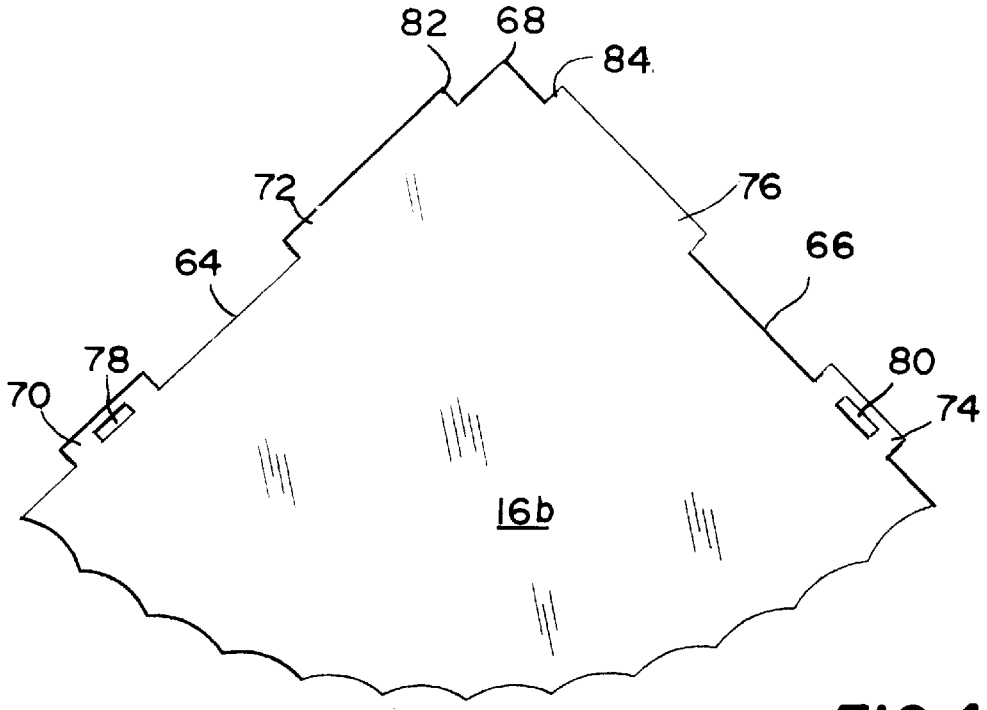
FIG. 4 is a top view of a base plate of the corner shelf illustrated in FIG. 1.

The base plates 16*a* and 16*b* provide a shelf member for holding and displaying objects on the assembled corner shelf assembly 10 as illustrated in FIG. 1. The base plates 16*a* and 16*b* in one embodiment are positioned approximately horizontal to the vertically orientated left and right support members 12 and 14. In other embodiments, the base plates 16*a* and 16*b* may be orientated at an angle deviating from horizontal as long as the base plates 16*a* and 16*b* provide a surface for holding objects. FIG. 4 illustrates one of the base plates 16*b*. Because both base plates 16*a* and 16*b* are identical, only one 16*b* will be described below. The base plate 16*b* has a left sidewall 64 and a right sidewall 66 that meet at a vertex 68. In the embodiment depicted in FIG. 4, the left side wall 64 and right sidewall 66 are orientated at approximately 90° to match the orientation of the left support member 12 connected to the right support member 14.

The base plates 16*b* is releasably connected to and are supported by the left and right base arms 20*b* and 38*b* respectively. The base plate 16*b* has a left and right ledge that overlays and abuts the edge of left and right base arms 32*b* and 60*b*, respectively. In the embodiment depicted in FIG. 4, the base plate 16*b* has a first left ledge 70, a second left ledge 72, a first right ledge 74 and a second right ledge 76.

To releasably connect the base plate 16*b* to the left and right base arms 20*b* and 38*b* respectively, the first left ledge 70 has a left base opening 78 for cooperating with the left tongue 30*b*, and the first right ledge 74 has a right base opening 80 for cooperating with the right tongue 58*b*. The left base opening 78 has a width and length that is approximately slightly larger than the width and length of the left tongue cross-section to allow the left tongue 30*b* to enter the left base opening 78 and to be held in place by friction. Similarly, the right base opening 80 has a width and length that is approximately slightly larger than the width and length of the right tongue cross-section to allow the right tongue 58*b* to enter the right base opening 80 and to be held in place by friction. When the left and right tongues 30*b* and 58*b* are held within the left and right base openings 78 and 80, these releasable connections prevent horizontal movement of the corner shelf components.

In addition to the left and right base openings 78 and 80, the base plate 16*b* has a left lip 82 on the second left ledge 72 and a right lip 84 on the second right ledge 76 to releasably connect the base plate 16*b* to the left and right base arms 20*b* and 38*b* respectively. The left lip 82 is capable of sliding below the left shoulder 34*b* to be captured. Likewise, the right lip 84 is capable of sliding below the right shoulder 62*b* to be captured. When the left and right lips 82 and 84 are captured by the left and right shoulders 34*b* and 62*b* respectively, the second left ledge 72 and the second right ledge 76 are prevented from moving in the vertical direction.

Figure 5:
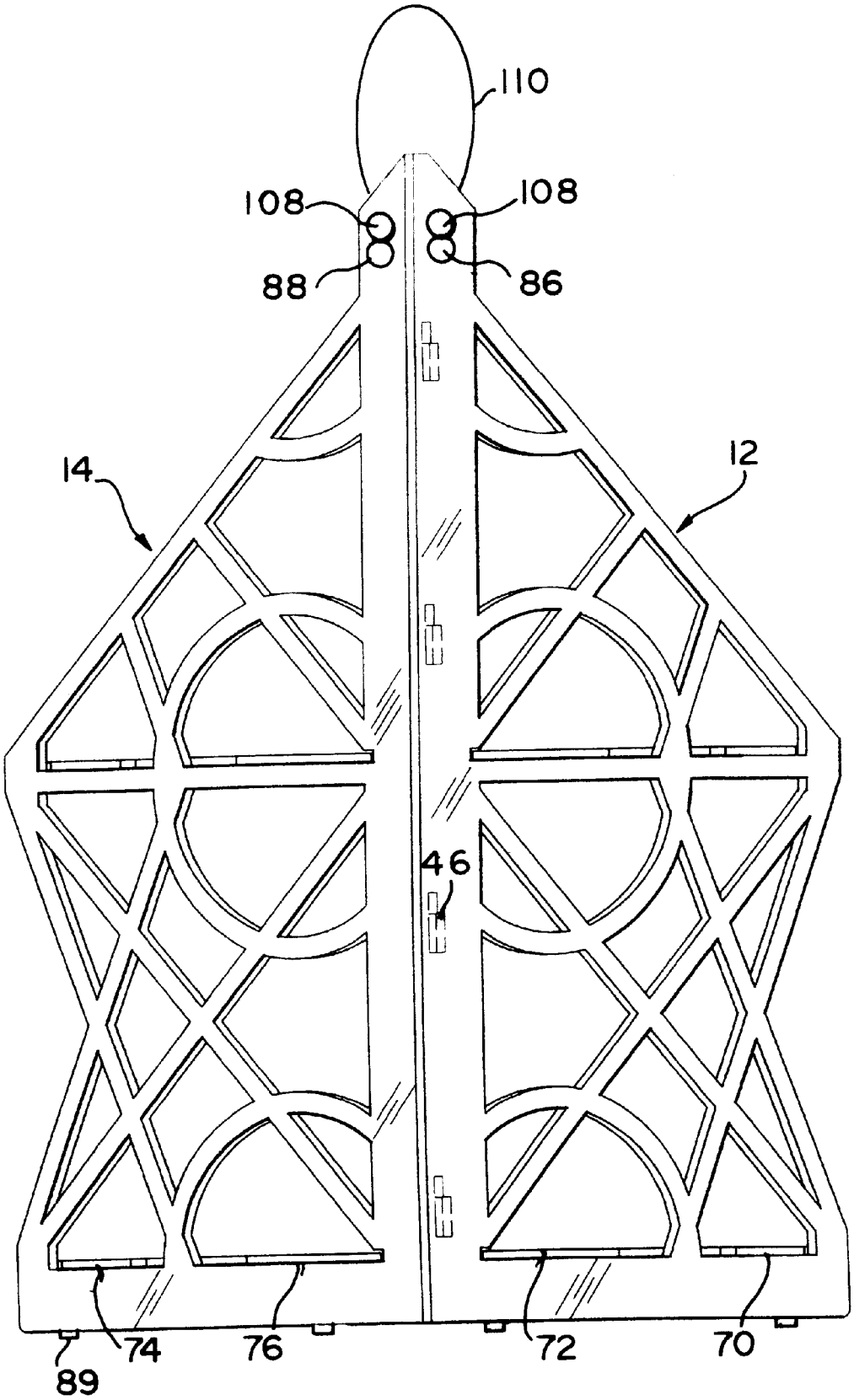
FIG. 5 is a rear elevational view of the assembled corner shelf illustrated in FIG. 1.

The corner shelf assembly 10 may be easily assembled and releasably connected together from the left support member 12, right support member 14 and base plates 16*a* and 16*b*. In one embodiment, the corner shelf assembly 10 is connected by first releasably connecting the left and right support members 12 and 14 to each other. To connect the left and right support members, the left and right support members 12 and 14 are orientated ninety degrees to each other, and the tab 46 of the right support member 14 is aligned with the opening 28 of the left support member 12. The tab 46 enters the opening 28 until the end 50 of the right vertical arm 36 abuts the left vertical arm 18. The right support member 14 then slides downward relative to the left support member 12 until the bottom portion 52 of the opening 28 abuts the top portion 54 of the notch 46. The connected left and right support members 12 and 14 are illustrated in FIG. 5.

Once the left and right support members 12 and 14 are connected at their ninety degree orientation, the base plate 16*b* is connected to the left and right support members 12 and 14. The vertex 68 of the base plate 16*b* is directed toward the intersection of the left and right support members 12 and 14, and the left and right lips 82 and 84 are directed toward the left and right shoulders 34*a* and 62*a*. The left and right lips 82 and 84 slide under the left and right shoulders 34*a* and 62*a*. As the lips and shoulders cooperate to connect the base plate 16*b* to the left and right support members 12 and 14, the left tongue 30*b* enters the left opening 78*b* and the right tongue 58*b* enters the right opening 80*b*. The base plate 16*b* is pushed downward until the ledges 72 and 74 abut the left shelf edge 32*b* and the right ledges 74 and 76 abut the right shelf edge 60*b*. The other base plate 16*a* may be connected to the left and right support members a similar fashion. The releasably connected base plates 16*a* and 16*b*, left and right support members 12 and 14 provide the assembled corner shelf 10. Once the left and right support members 12 and 14 and base plates 16*a* and 16*b* are releasably connected as described above, the corner shelf 10 is a rigid formation that may be hung on a wall surface. To disassemble the corner shelf 10, the above steps may be performed in reverse.

The components of the corner shelf assembly 10 may be made out of any suitable material. In one embodiment, the left support member 12, right support member 14 and base plates 16*a* and 16*b* are composed of a rigid plastic approximately ¼ inch thick. The left and right vertical arms 18 and 36 are approximately 15.25 inches, the left and right base arms 20*a*, 20*b*, 38*a* and 38*b* are approximately 7 inches, and the sidewalls 64 and 66 of the base plates 16*a* and 16*b* are approximately 6.75 inches. The left support member 12, right support member 14 and base plates 16*a* and 16*b* may be formed in a mold or cut from a plastic sheet. In other embodiments, the left support member 12, right support member 14 and base plates 16*a* and 16*b* may be composed of metal, glass, wood or any suitably rigid material.

The corner shelf assembly 10 comprising the left support member 12, right support member 12 and base plates 16*a* and 16*b* of the present invention corner shelf that may be easily assembled and disassembled by consumers. The left support member 12, right support member 12 and base plates 16*a* and 16*b* when disassembled may be placed flat against each other into a small package for sale to consumers. Thus, the corner shelf assembly 10 of the present invention requires a small amount of retail space when being displayed for sale and a small amount of shipping space when being delivered. Additionally, the disassembled corner shelf assembly requires small storage space for consumers. Furthermore, the corner shelf assembly 10 in its disassembled state requires little protective packaging when being shipped to protect the left support member 12, right support member 12 and base plates 16*a* and 16*b*.

The connected corner shelf 10 depicted in FIG. 1 may be mounted to the vertical walls meeting at a corner. The connected corner shelf 10 may be hung with a nail (not shown) attached to one of the wall meeting at the corner through either hole 86 in the left support member 12 or hole 88 in the right support member 14. Because the left and right support members 12 and 14 are orientated at approximately 90° as illustrated in FIG. 5, the corner shelf 10 fits into a corner with the vertical walls intersecting at 90°. When the connected corner shelf 10 is mounted to the vertical walls meeting at a corner, the left support member 12 aligns with one of the walls and the right support member 14 aligns with the other wall. When the corner shelf 10 is mounted in the corner, the outer edges of the first and second left ledges 70 and 72, outer edges of the first and second right ledges 74 and 76, the outer edges of the tab 46 and the overlap edge 104 of the left support member 12 abut the flat wall surfaces (not shown). To ensure that the corner shelf 10 rests squarely against the corner surfaces, the amount the first and second left and right ledges 70, 72, 74 and 76 extend past the left and right support members are approximately equal to each other which is also approximately equal to the amount the tab 46 extends past the left support Member 12 which is further approximately equal to the amount of overlap 104 of the left support member 12 to the right support member 14.

Instead of mounting the corner shelf 10 to a wall, the corner shelf 10 may be placed on a table, desk or other flat surface. When the corner shelf 10 is placed on the flat surface, the base arms 20*a* and 38*a* of the left and right support member 12 and 14 rest on the flat surface to support the corner shelf 10. In one embodiment, the edges of the base arms 20*a* and 38*a* that contact the flat surface are provided with friction feet 89 (see FIGS. 2, 3 and 5) to help prevent the corner shelf 10 from moving on the flat surface. The friction feet 89 may be composed of wax dots, rubber disks or any other friction providing material.

Figure 6A:
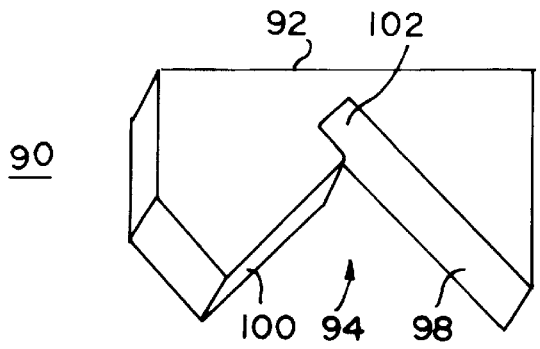
FIG. 6*a* is an isometric view of a flat mount device.
Figure 6B:
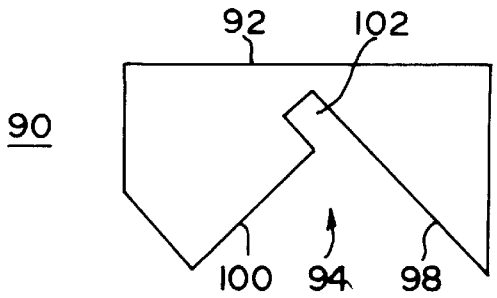
FIG. 6*b* is a top plan view of the flat mount device illustrated in FIG. 6*a;*
Figure 6C:
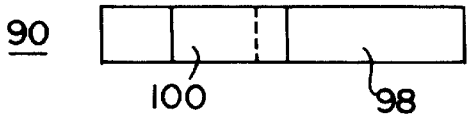
FIG. 6*c* is a front elevational view of the flat mount device illustrated in FIG. 6*a;*
Figure 8:
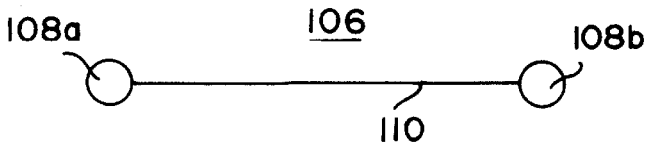
FIG. 8 is a front elevational view of a hanging means.

Additionally, the corner shelf may be mount to a flat vertical wall. To mount the corner shelf assembly 10 to a flat vertical wall, a flat wall mounting member 90 is used. FIGS. 6*a*, 6*b* and 6*c* illustrate the flat wall mounting member 90 of the present invention. The flat wall mounting member 90 has a wall edge 92 and a corner shelf edge 94 opposed to each other. The wall edge 92 provides a flat surface for abutting the flat vertical wall surface 96. FIG. 8 illustrates the corner shelf 10 mounted to a flat vertical wall surface 96 using the flat wall mounting member 90.

Figure 7:
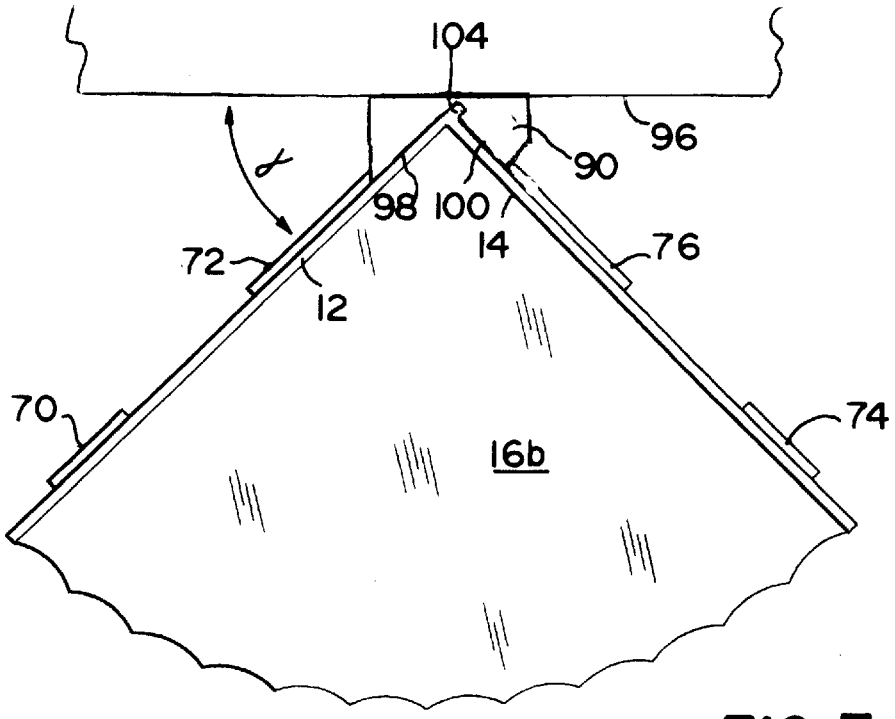
FIG. 7 is a top plan view of the flat wall mounting member and assembled corner shelf.

The corner shelf edge 94 of the flat wall mounting member 90 has a left support edge 98 and a right support edge 100. The left support edge 98 is orientated to the right support edge 100 at the same angle as the left support member 12 is orientated to the right support member 14. In one embodiment, the left support edge 98 is approximately perpendicular to the right support edge 100. The left support edge 98 provides a support surface for the left support member 12, and the right support edge 100 provides a support surface for the right support member 14. The left support edge 98 and right support edge 100 hold the corner shelf 10 at a display angle relative the flat wall surface 96. In the embodiment depicted in FIG. 7, the $\alpha$ display angle is approximately 45°; however, in other embodiments, the display angle may be greater or less than 45°.

In one embodiment, the flat wall mounting member 90 further includes a notch portion 102. The notch portion 102 is capable of capturing and supporting an overlap 104 of the left support member 12 relative to the right support member 14. Because the notch portion 102 captures the overlap 104, the flat wall mounting member 90 reduces the tendency of the corner shelf to slide on the corner shelf edge 94.

To mount the connected corner shelf 10 to the flat vertical wall surface 96, the flat wall mounting member 90 would be attached to the flat vertical wall surface 96. The flat wall mounting member 90 may be attached to the wall surface 96 by adhering the wall edge 92 to the wall surface 96 using an adhesive, nail or other attaching means. The connected corner shelf 10 would be hung on a nail (not shown) in the flat vertical wall surface 96 positioned above the flat wall mounting member 90. In one embodiment, a hanging means 106 is used to hang the corner shelf 10 to the nail. FIG. 8 illustrates the hanging means 106. The hanging means 106 comprises a pair of plastic balls 108*a* and 108*b* connected with a nylon string 110. The plastic ball 108*a* passes through the hole 86 in the left support member 12, and the ball 108*a* moves upward adjacent a narrowed opening 112 with the nylon string 110 within the narrowed opening 112. The plastic ball 108*b* passes through the hole 88 in the right support member 14 and the ball 108*b* moves upward adjacent a narrowed opening 114 with the nylon string 110 within the narrowed opening 114. The plastic balls 108*a* and 108*b* do not fit through the narrowed openings 112 and 114, so the nylon string 110 connecting the two plastic balls 108*a* and 108*b* may be hung on the nail to hang the corner shelf 10. FIG. 5 illustrates the hanging means 106 attached to the corner shelf 10. The corner shelf 10 hanging from the nail by the hanging means 106 would rest upon and be supported by the flat wall mounting member 90. In another embodiment, the corner shelf 10 may be rest upon and be supported by several flat wall mounting members 90 aligned vertically and adhered to the wall surface 96.

The flat wall mounting member 90 may be made out of any suitable material. In one embodiment, the flat wall mounting member 90 is composed of rigid plastic having the dimensions of approximately 0.187 inch thick by approximately 1.126 inches wide and approximately 0.655 inches deep. In other embodiments, the flat wall mounting member 90 may be composed of metal, glass, wood or any suitably rigid material.

While particular embodiments and applications of the present invention have been illustrated and described, it is to be understood that the invention is not limited to the precise construction and compositions disclosed herein and that various modifications, changes, and variations will be apparent from the foregoing descriptions without departing from the spirit and scope of the invention as defined in the appended claims.

What is claimed is:

1. A corner shelf assembly adapted to be mounted to vertical walls meeting at a corner, the corner shelf assembly comprising:

a) a left support member having a left vertical arm and at least one left base arm intersecting at an angle, said left vertical arm having at least one opening, said left base arm having a left base arm edge, said left base arm including a left tongue extending upwardly from said left base arm edge;

b) a right support member orientated perpendicular to said left support member, said right support member having a right vertical arm and at least one right base arm intersecting at an angle, said right vertical arm having at least one tab capable of entering said opening in said left support member and releasably interlocking said right support member to said left support member, said right base arm having a right base arm edge, said right base arm including a right tongue extending upwardly from said right base arm edge; and c) at least one base plate releasably connected to said left base arm and to said right base arm, said base plate having a left opening capable of accepting said left tongue and a right opening capable of accepting said right tongue to releasably connect said base plate to said left support member and to said right support member.

2. The corner shelf assembly of claim 1 wherein said left support member further includes a left shoulder at the intersection of said left vertical arm and said left base arm;

said right support member further includes a right shoulder at the intersection of said right vertical arm and said right base arm; and said base plate further includes a left lip capable of sliding beneath said left shoulder and a right lip capable of sliding beneath said right shoulder to releasably connect said base plate to said left support member and to said right support member.

3. The corner shelf assembly of claim 1 wherein said left support member further includes a left cross arm extending from a point above the intersection of said left vertical arm and said left base arm to a display end of said left base arm; and said right support member further includes a right cross extending from a point above the intersection of said right vertical arm and said right base arm to a display end of said right base arm.

4. The corner shelf assembly of claim 1 wherein said tab has a notch capable of releasably interlocking said right support member to said left support member, said tab enters said opening until said right vertical arm abuts said left vertical arm, said notch allowing said right vertical arm to slide downward relative to said left support member until a bottom portion of said opening abuts a top portion of said notch.

5. The corner shelf assembly of claim 1 wherein said base plate further includes a left sidewall and a right sidewall, said left sidewall being orientated approximately perpendicular to said right sidewall, said left sidewall intersecting said right sidewall at a vertex, when said base plate releasably connected to said left support member, said left sidewall adjacent said vertex abutting said left vertical arm, when said base plate releasably connected to said right support member, said right sidewall adjacent said vertex abutting said right vertical arm.

6. The corner shelf assembly of claim I wherein said base plate further includes a left ledge and a right ledge, when said base plate is releasably connected to said left support member said left ledge abuts said left base arm edge, when said base plate is releasably connected to said right support member said right ledge abuts said right base arm edge.

7. The corner shelf assembly of claim 6 wherein said left ledge extends a predetermined distance past said left support member, said right ledge extends said predetermined distance past said right support member, and said tab when releasably interlocked with said left support member extends said predetermined distance past said left support member.

8. The corner shelf assembly of claim 1 having wherein said left support member has at least two left base arms and said right support member has at least two base arms to accommodate at least two base plates.

9. A corner shelf assembly adapted to be mounted to a flat vertical wall, the corner shelf assembly comprising:

a) a left support member having a left vertical arm and at least one left base arm intersecting at an angle, said left vertical arm having at least one opening, said left base arm having a left base arm edge, said left base arm including a left tongue extending from said left base arm edge;

b) a right support member orientated at a predetermined angle to said left support member, said right support member having a right vertical arm and at least one right base arm intersecting at an angle, said right vertical arm having at least one tab capable of entering said opening in said left support member and releasably interlocking said right support member to said left support member, said right base arm having a right base arm edge, said right base arm including a right tongue extending from said right base arm edge;

c) at least one base plate releasably connected to said left base arm and to said right base arm, said base plate having a left opening capable of accepting said left tongue and a right opening capable of accepting said right tongue to releasably connect said base plate to said left support member and to said right support member; and d) a flat wall mounting member having a wall edge adapted to abut said flat wall surface and a corner shelf edge adapted to support said left support member and said right support member at a display angle to said w said corner shelf edge of said flat wall mounting member further includes a left support edge and a right support edge, said left support edge orientated at said predetermined angle to said right support edge, said left support edge abuts and supports said left support member and said right support edge abuts and supports said right support member.

10. The corner shelf assembly of claim 9 wherein said predetermined angle is approximately ninety degrees.

11. The corner shelf assembly of claim 9 wherein said left support member further includes a left shoulder at the intersection of said left vertical arm and said left base arm;

said right support member further includes a right shoulder at the intersection of said right vertical arm and said right base arm; and said base plate further includes a left lip capable of sliding beneath said left shoulder and a right lip capable of sliding beneath said right shoulder to releasably connect said base plate to said left support member and to said right support member.

12. The corner shelf assembly of claim 9 wherein said left support member further includes a left cross arm extending from a point above the intersection of said left vertical arm and said left base arm to a display end of said left base arm; and said right support member further includes a right cross extending from a point above the intersection of said right vertical arm and said right base arm to a display end of said right base arm.

13. The corner shelf assembly of claim 9 wherein said tab has a notch capable of releasably interlocking said right support member to said left support member, said tab enters said opening until said right vertical arm abuts said left vertical arm, said notch allowing said right vertical arm to slide downward relative said left support member until a bottom portion of said opening abuts a top portion of said notch.

14. The corner shelf assembly of claim 9 wherein said base plate further includes a left sidewall and a right sidewall, said left sidewall being orientated at said predetermined angle to said right sidewall, said left sidewall intersecting said right sidewall at a vertex, when said base plate releasably connected to said left support member, said left sidewall adjacent said vertex abutting said left vertical arm, when said base plate releasably connected to said right support member, said right sidewall adjacent said vertex abutting said right vertical arm.

15. The corner shelf assembly of claim 9 wherein said base plate further includes a left ledge and a right ledge, when said base plate is releasably connected to said left support member said left ledge abuts said left base arm edge, when said base plate is releasably connected to said right support member said right ledge abuts said right base arm edge.

16. The corner shelf assembly of claim 9 further including a hanging means for hanging said corner shelf from said flat vertical wall, said hanging means having a pair of balls connected by a string.

17. The corner shelf assembly of claim 9 further including a left hanging opening in said left support member and a right hanging opening in said right support member, said left and said hanging openings having a circular portion and a narrowed portion, said balls capable of passing through said circular portion and not said narrowed portion.

18. A corner shelf assembly adapted to be mounted to a vertical wall surface, the corner shelf assembly comprising:

a) a left support member having a left vertical arm and at least one left base arm intersecting at an angle, said left vertical arm having at least one left vertical connecting member, said left base arm including at least one left horizontal connecting member;

b) a right support member orientated perpendicular to said left support member, said right support member having a right vertical arm and at least one right base arm intersecting at an angle, said right vertical arm having at least one right vertical connecting member capable of cooperating with said left vertical connecting member to releasably interlocking said right support member to said left support member, said right base arm having a right base arm edge, said right base arm including at least one right horizontal connecting member;

c) at least one base plate releasably connected to said left base arm and to said right base arm, said base plate having a left base connecting member capable of cooperating with said left horizontal connecting member to releasably interlock said base plate to said left support member, said base plate having a right base connecting member capable of cooperating with said right horizontal connecting member to releasably interlock said base plate to said right support member and d) a hanging means for hanging said corner shelf from said flat vertical wall, said hanging means having a pair of balls connected by a string.

19. The corner shelf assembly of claim 18 wherein said left vertical connecting member is an opening in said left vertical arm, said right vertical connecting member is a tab extending from an edge of said right vertical arm, said tab has a notch adjacent said edge of said right vertical arm, said tab enters said opening until said edge of said right vertical arm abuts said left vertical arm, said notch allowing said vertical arm to slide downward relative said left support member until a bottom portion of said opening abuts a top portion of said notch.

20. The corner shelf assembly of claim 18 wherein said left horizontal connecting member is a left tongue extending from a left base arm edge of said left base arm, said right horizontal connecting member is a right tongue extending from a right base arm edge of said right base arm, said left base connecting member is a left opening, said left tongue enters said left opening to releasably interlock said base plate to said left support member, said right base connecting member is a right opening, said right tongue enters said right opening to releasably interlock said base plate to said right support member.

21. The corner shelf assembly of claim 18 wherein said left horizontal connecting member is a left shoulder at the intersection of said left vertical arm and said left base arm;

said right horizontal connecting member is a right shoulder at the intersection of said right vertical arm and said right base arm; and said left base connecting member is a left lip capable of sliding beneath said left shoulder and said right base connecting member is a right lip capable of sliding beneath said right shoulder.

22. The corner shelf assembly of claim 18 further including a left hanging opening in said left support member and a right hanging opening in said right support member, said left and said hanging openings having a circular portion and a narrowed portion, said balls capable of passing through said circular portion and not said narrowed portion.

* * * * *

UNITED STATES PATENT AND TRADEMARK OFFICE

CERTIFICATE OF CORRECTION

| | | |
|---|---|---|
| PATENT NO. | : | 5,983,805 |
| DATED | : | November 16, 1999 |
| INVENTOR(S) | : | Casey E. Waluda |

It is certified that error appears in the above-identified patent and that said Letters Patent is hereby corrected as shown below:

Column 10, line 42: "angle to said w" should read –angle to said wall,--

Signed and Sealed this

Eleventh Day of July, 2000

*Attest:*

Q. TODD DICKINSON

*Attesting Officer*

*Director of Patents and Trademarks*